US010797385B2

(12) United States Patent
Yu et al.

(10) Patent No.: US 10,797,385 B2
(45) Date of Patent: Oct. 6, 2020

(54) ANTENNA, ANTENNA APPARATUS, TERMINAL, AND METHOD FOR ADJUSTING WORKING FREQUENCY BAND OF ANTENNA

(71) Applicant: Huawei Device (Dongguan) Co., Ltd., Dongguan (CN)

(72) Inventors: Dong Yu, Shanghai (CN); Liang Xue, Shanghai (CN); Meng Hou, Shanghai (CN); Jiaqing You, Shanghai (CN); Lei Wang, Shanghai (CN); Zhaocai Zeng, Shanghai (CN)

(73) Assignee: HUAWEI DEVICE CO., LTD., Dongguan (CN)

( * ) Notice: Subject to any disclaimer, the term of this patent is extended or adjusted under 35 U.S.C. 154(b) by 410 days.

(21) Appl. No.: 15/032,392

(22) PCT Filed: Dec. 12, 2013

(86) PCT No.: PCT/CN2013/089277

§ 371 (c)(1),
(2) Date: Apr. 27, 2016

(87) PCT Pub. No.: WO2015/085553

PCT Pub. Date: Jun. 18, 2015

(65) Prior Publication Data

US 2016/0276742 A1 Sep. 22, 2016

(51) Int. Cl.
*H01Q 1/48* (2006.01)
*H01Q 1/24* (2006.01)
(Continued)

(52) U.S. Cl.
CPC ..... *H01Q 1/48* (2013.01); *H01Q 1/243* (2013.01); *H01Q 5/371* (2015.01); *H01Q 9/04* (2013.01); *H01Q 9/42* (2013.01)

(58) Field of Classification Search
CPC ..... H01Q 1/48; H01Q 1/243; H01Q 9/04; H01Q 5/371; H01Q 9/42
See application file for complete search history.

(56) References Cited

U.S. PATENT DOCUMENTS 9,406,998 B2 * 8/2016 Korva ..... H01Q 1/243
2007/0035456 A1 2/2007 Jeong
(Continued)

FOREIGN PATENT DOCUMENTS

CN 1913222 A 2/2007
CN 102577333 A 7/2012
(Continued)

OTHER PUBLICATIONS

Foreign Communication From a Counterpart Application, Chinese Application No. 201380071488.0, Chinese Search Report dated Sep. 6, 2016, 2 pages.
(Continued)

*Primary Examiner* — Graham P Smith
*Assistant Examiner* — Jae K Kim
(74) *Attorney, Agent, or Firm* — Conley Rose, P.C.

(57) ABSTRACT

An antenna, an antenna apparatus, and a terminal are provided. The antenna includes a feeding point, a feeding stub, and a coupling stub. The feeding stub is electrically connected to the feeding point. The coupling stub is coupled to the feeding stub. The coupling stub includes at least two grounding points By selecting different grounding combinations of the at least two grounding points of the coupling stub, an antenna clearance area does not need to be increased while multi-frequency coverage of the antenna is implemented.

12 Claims, 8 Drawing Sheets

(51) Int. Cl.

| | |
|---|---|
| ***H01Q 9/04*** | (2006.01) |
| ***H01Q 5/371*** | (2015.01) |
| ***H01Q 9/42*** | (2006.01) |

(56) References Cited

U.S. PATENT DOCUMENTS

| | | | | |
|---|---|---|---|---|
| 2007/0229376 | A1 | 10/2007 | Desclos et al. | |
| 2009/0189815 | A1* | 7/2009 | Hotta | H01Q 9/38 343/700 MS |
| 2010/0045553 | A1* | 2/2010 | Ohira | H01Q 21/061 343/749 |
| 2010/0112965 | A1 | 5/2010 | Buccafusca et al. | |
| 2010/0117922 | A1* | 5/2010 | Fukuda | H01Q 3/446 343/876 |
| 2010/0328164 | A1* | 12/2010 | Huynh | H01Q 5/378 343/702 |
| 2011/0183633 | A1 | 7/2011 | Ohba et al. | |
| 2011/0217939 | A1* | 9/2011 | Hirota | H04B 1/04 455/123 |
| 2012/0112965 | A1 | 5/2012 | Yen et al. | |
| 2012/0162025 | A1 | 6/2012 | Cohn et al. | |
| 2012/0196651 | A1 | 8/2012 | Nakamura | |
| 2013/0241796 | A1 | 9/2013 | Nagumo | |
| 2013/0257679 | A1* | 10/2013 | Wong | H01Q 1/243 343/876 |
| 2014/0024323 | A1 | 1/2014 | Clevorn et al. | |
| 2014/0159982 | A1* | 6/2014 | De Luis | H01Q 5/378 343/843 |
| 2016/0099501 | A1* | 4/2016 | Rowson | H01Q 3/00 343/833 |

FOREIGN PATENT DOCUMENTS

| | | | |
|---|---|---|---|
| CN | 102594946 | A | 7/2012 |
| CN | 202352829 | U | 7/2012 |
| CN | 103022642 | A | 4/2013 |
| CN | 103199342 | A | 7/2013 |
| CN | 103222113 | A | 7/2013 |
| CN | 103326124 | A | 9/2013 |
| CN | 103582047 | A | 2/2014 |
| TW | 201103194 | A | 1/2011 |
| WO | 2008010149 | A1 | 1/2008 |

OTHER PUBLICATIONS

Foreign Communication From a Counterpart Application, Chinese Application No. 201380071488.0, Chinese Office Action dated Oct. 8, 2016, 9 pages.

Machine Translation and Abstract of Chinese Publication No. CN103022642, Apr. 3, 2013, 8 pages.

Machine Translation and Abstract of Chinese Publication No. CN202352829, Jul. 25, 2012, 8 pages.

Foreign Communication From a Counterpart Application, Chinese Application No. 201380071488.0, Chinese Search Report dated Mar. 2, 2017, 2 pages.

Foreign Communication From a Counterpart Application, Chinese Application No. 201380071488.0, Chinese Office Action dated Mar. 20, 2017, 8 pages.

Partial English Translation and Abstract of Chinese Patent Application No. CN103326124, Apr. 25, 2016, 4 pages.

Machine Translation and Abstract of Chinese Publication No. CN102594946, Jul. 18, 2012, 16 pages.

Foreign Communication From a Counterpart Application, Chinese Application No. 201710596439.9, Chinese Office Action dated Apr. 3, 2019, 7 pages.

Machine Translation and Abstract of Taiwanese Publication No. TW201103194, Jan. 16, 2011, 17 pages.

Foreign Communication From a Counterpart Application, Chinese Application No. 2017105964399, Chinese Notice of Allowance dated Oct. 17, 2019, 4 pages.

Partial English Translation and Abstract of Chinese Patent Application No. CN103326124, dated Sep. 25, 2016, 4 pages.

Foreign Communication From a Counterpart Application, European Application No. 13899022.1, Extended European Search Report dated Oct. 27, 2016, 7 pages.

Foreign Communication From a Counterpart Application, PCT Application No. PCT/CN2013/089277, English Translation of International Search Report dated Sep. 16, 2014, 2 pages.

Foreign Communication From a Counterpart Application, PCT Application No. PCT/CN2013/089277, English Translation of Written Opinion dated Sep. 16, 2014, 14 pages.

* cited by examiner

ANTENNA, ANTENNA APPARATUS, TERMINAL, AND METHOD FOR ADJUSTING WORKING FREQUENCY BAND OF ANTENNA

CROSS-REFERENCE TO RELATED APPLICATIONS

This application is a National Stage of International Application No. PCT/CN2013/089277, filed on Dec. 12, 2013, which is hereby incorporated by reference in its entirety.

TECHNICAL FIELD

The present disclosure relates to the field of mobile communications technologies, and in particular, to an antenna, an antenna apparatus, a terminal, and a method for adjusting a working frequency band of an antenna.

BACKGROUND

A clearance area refers to a smallest clean space reserved around an antenna such that the antenna has a wider working bandwidth (each antenna has its own center resonance frequency, when the antenna deviates from the center resonance frequency, some electrical characteristics of the antenna may deteriorate; when the electrical characteristics deteriorate to allowed values corresponding to a range of start and end frequencies, the range is a working frequency band of the antenna, and a width of the working frequency band is the working bandwidth), and no other components that affect working efficiency of the antenna can exist in the clean space. If the antenna is regarded as a point, the clearance area may be understood as a spherical space. When the clearance area is analyzed, generally a shortest distance (equivalent to a radius of the spherical space) is used to represent a size of the clearance area.

In the prior art, in a manner of adding a coupling stub, a working bandwidth of a single antenna may be increased, but an effect of the increasing is general, and it is difficult to further increase the resonance frequency of the antenna to obtain more working frequency bands. In addition, the antenna clearance area and the antenna bandwidth have a close relationship. If the bandwidth is wider, a requirement on the clearance area is higher. Therefore, the clearance area needs to be increased provided that a wider bandwidth needs to be obtained. For example, in a solution of a single antenna in the prior art, an antenna clearance area of only 7 millimeters (mm) is required in order to cover 698 megahertz (MHz) to 960 MHz or 1710 MHz to 2700 MHz, but when an antenna needs to cover both the two frequency bands, the antenna clearance area needs to be increased to more than 10 mm such that the antenna can have relatively high antenna efficiency. However, for a small-sized hand-held terminal, it is difficult to provide a clearance area of more than 10 mm to an antenna.

SUMMARY

In view of this, embodiments of the present disclosure provide an antenna, an antenna apparatus, a terminal, and a method for adjusting a working frequency band of an antenna, which can resolve a problem that a clearance area needs to be increased in multi-frequency coverage of the antenna.

To achieve the foregoing objective, the following technical solutions are provided in the embodiments of the present disclosure.

According to a first aspect, an antenna is provided and includes a feeding point, a feeding stub, and a coupling stub, where the feeding stub is electrically connected to the feeding point, the coupling stub is coupled to the feeding stub, and the coupling stub includes at least two grounding points, where one grounding point in the at least two grounding points is used for grounding, and the other grounding point or grounding points are selectively grounded or not grounded, or when one grounding point in the at least two grounding points is grounded, the other grounding point or grounding points are selectively grounded or not grounded.

In a first possible implementation manner of the first aspect, that one grounding point in the at least two grounding points is used for grounding, and the other grounding point or grounding points are selectively grounded or not grounded, specifically includes the one grounding point is grounded directly, and the other grounding point or grounding points are selectively grounded or not grounded using a switch.

In a second possible implementation manner of the first aspect, that when one grounding point is grounded, the other grounding point or grounding points are selectively grounded or not grounded, specifically includes, when the one grounding point is grounded using a switch, the other grounding point or grounding points are selectively grounded or not grounded using a switch.

With reference to the first aspect or the first or second possible implementation manner of the first aspect, in a third possible implementation manner, that one grounding point is grounded specifically includes the one grounding point is grounded at an end of the coupling stub, where a current path from the end to a farthest radiating point on the coupling stub is longest.

According to a second aspect, an antenna apparatus is provided and includes an antenna, a first acquiring unit, and a control unit, where the first acquiring unit is electrically connected to the control unit, the control unit is electrically connected to the antenna, and the antenna includes a feeding point, a feeding stub, and a coupling stub, where the feeding stub is electrically connected to the feeding point, the coupling stub is coupled to the feeding stub, and the coupling stub includes at least two grounding points, where one grounding point in the at least two grounding points is used for grounding, and the other grounding point or grounding points are selectively grounded or not grounded, or when one grounding point in the at least two grounding points is grounded, the other grounding point or grounding points are selectively grounded or not grounded, the first acquiring unit is configured to acquire a target working frequency band, the control unit is configured to adjust a grounding combination of the antenna according to the target working frequency band, and the grounding combination includes a combination in which the at least two grounding points are grounded or not grounded.

In a first possible implementation manner of the second aspect, the antenna apparatus further includes a storage unit, where the storage unit is electrically connected to the control unit, and the storage unit is configured to store a grounding status table, where the grounding status table records a correspondence between a grounding combination and a working frequency band of the antenna, and the adjusting a working frequency band of the antenna according to the target working frequency band specifically includes finding the corresponding working frequency band of the antenna in the grounding status table according to the target working frequency band, and selecting the grounding combination according to the correspondence between the grounding combination and the working frequency band of the antenna that is recorded in the grounding status table.

With reference to the first possible implementation manner of the second aspect, in a second possible implementation manner, the antenna apparatus further includes a second acquiring unit, where the second acquiring unit is electrically connected to the control unit, and is configured to acquire a holding status of a user, the grounding status table further records a correspondence among the working frequency band of the antenna, the holding status, and the grounding combination, the control unit is further configured to adjust the working frequency band of the antenna according to the target working frequency band and the holding status of the user, and the adjusting the working frequency band of the antenna according to the target working frequency band and the holding status of the user specifically includes finding the corresponding working frequency band of the antenna in the grounding status table according to the target working frequency band and the holding status, and selecting the grounding combination according to the correspondence among the working frequency band of the antenna, the holding status, and the grounding combination that is recorded in the grounding status table.

With reference to the second possible implementation manner of the second aspect, in a third possible implementation manner, the second acquiring unit is a user input apparatus, and that the second acquiring unit acquires a holding status of a user specifically includes acquiring the holding status according to a selection made by the user at discretion in the user input apparatus, or the second acquiring unit is a sensor, and that the second acquiring unit acquires a holding status of a user specifically includes the sensor determines the holding status according to hand holding, or the sensor determines the holding status according to a slide trace of a finger.

With reference to the second aspect or any one of the first to third possible implementation manners of the second aspect, in a fourth possible implementation manner, that one grounding point in the at least two grounding points is used for grounding, the other grounding point or grounding points are selectively grounded or not grounded, specifically includes the one grounding point is grounded directly, and the other grounding point or grounding points are selectively grounded or not grounded using a switch.

With reference to the second aspect or any one of the first to third possible implementation manners of the second aspect, in a fifth possible implementation manner, that when one grounding point in the at least two grounding points is grounded, the other grounding point or grounding points are selectively grounded or not grounded, specifically includes, when the one grounding point is grounded using a switch, the other grounding point or grounding points are selectively grounded or not grounded using a switch.

With reference to the second aspect or any one of the first to fifth possible implementation manners of the second aspect, in a sixth possible implementation manner, that one grounding point is grounded specifically includes the one grounding point is grounded at an end of the coupling stub, where a current path from the end to a farthest radiating point on the coupling stub is longest.

With reference to the second aspect or any one of the first to sixth possible implementation manners of the second aspect, in a seventh possible implementation manner, the first acquiring unit is a user input apparatus, and that the first acquiring unit acquires a target working frequency band specifically includes acquiring a working frequency band of an operator according to a selection made by the user at discretion in the user input apparatus.

According to a third aspect, a terminal is provided, where the terminal includes a body and any one antenna apparatus according to the second aspect, where the antenna apparatus is disposed on the body.

According to a fourth aspect, a method for adjusting a working frequency band of an antenna is provided and includes acquiring a target working frequency band, and adjusting a grounding combination of the antenna such that the working frequency band of the antenna is adjusted to correspond to the target working frequency band.

In a first possible implementation manner of the fourth aspect, the antenna includes at least two grounding points, where one grounding point in the at least two grounding points is used for grounding, and the other grounding point or grounding points are selectively grounded or not grounded, the adjusting a grounding combination of the antenna such that the working frequency band of the antenna is adjusted to correspond to the target working frequency band, specifically includes presetting a grounding status table in a terminal in which the antenna is located, where the grounding status table records a correspondence between the grounding combination and the working frequency band of the antenna, and the grounding combination includes a combination in which the at least two grounding points are grounded or not grounded, and finding the corresponding working frequency band of the antenna in the grounding status table according to the target working frequency band, and selecting the grounding combination according to the correspondence between the grounding combination and the working frequency band of the antenna that is recorded in the grounding status table.

In a second possible implementation manner of the fourth aspect, the antenna includes at least two grounding points, where when one grounding point in the at least two grounding points is grounded, the other grounding point or grounding points are selectively grounded or not grounded, and the adjusting a grounding combination of the antenna such that the working frequency band of the antenna is adjusted to correspond to the target working frequency band, specifically includes presetting a grounding status table in a terminal in which the antenna is located, where the grounding status table records a correspondence between the grounding combination and the working frequency band of the antenna, and the grounding combination includes a combination in which the at least two grounding points are grounded or not grounded, and finding the corresponding working frequency band of the antenna in the grounding status table according to the target working frequency band, and selecting the grounding combination according to the correspondence between the grounding combination and the working frequency band of the antenna that is recorded in the grounding status table.

With reference to the first or second possible implementation manner of the fourth aspect, in a third possible implementation manner, the method further includes acquiring a holding status of a user, where the grounding status table further records a correspondence among the working frequency band of the antenna, the holding status, and the grounding combination, and finding the corresponding working frequency band of the antenna in the grounding status table according to the target working frequency band and the holding status, and selecting the grounding combination according to the correspondence recorded in the grounding status table.

With reference to the third possible implementation manner of the fourth aspect, in a fourth possible implementation manner, the acquiring a holding status of a user includes acquiring the holding status according to a selection made by the user at discretion, or determining, by a sensor, the holding status according to hand holding, or determining, by a sensor, the holding status according to a slide trace of a finger.

With reference to the fourth aspect or any one of the first to fourth possible implementation manners of the fourth aspect, in a fifth possible implementation manner, the acquiring a target working frequency band includes acquiring a working frequency band of an operator according to a selection made by the user at discretion.

The embodiments of the present disclosure provide an antenna, an antenna apparatus, a terminal, and a method for adjusting a working frequency band of an antenna. According to the antenna provided in the embodiments of the present disclosure, an appropriate grounding combination is selected to change a resonance frequency of the antenna and a corresponding working frequency band. Because different grounding combinations are selected and corresponding to different working frequency bands of the antenna, an antenna clearance area needs only to meet a maximum clearance area requirement in various grounding combinations without needing to meet clearance area requirements of the antenna working in all working frequency bands, in this case, the clearance area does not need to be increased while multi-frequency coverage of the antenna is implemented.

BRIEF DESCRIPTION OF DRAWINGS

To describe the technical solutions in the embodiments of the present disclosure or in the prior art more clearly, the following briefly introduces the accompanying drawings required for describing the embodiments or the prior art. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly and completely describes the technical solutions in the embodiments of the present disclosure with reference to the accompanying drawings in the embodiments of the present disclosure. The described embodiments are merely some but not all of the embodiments of the present disclosure. All other embodiments obtained by a person of ordinary skill in the art based on the embodiments of the present disclosure without creative efforts shall fall within the protection scope of the present disclosure.

The following description and drawings focus on an antenna that is applicable to a mobile phone. However, it should be understood that, the present disclosure is not limited to the application, but may be applied to many other communications terminals that implement antenna solution design according to the embodiments of the present disclosure, including a mobile phone, a pager, a communicator, an electronic manager, a smartphone, a personal digital assistant (PDA) personal digital assistant, a vehicle-mounted radio communications apparatus, a computer, a printer, a fax machine, and the like.

Figure 1A:
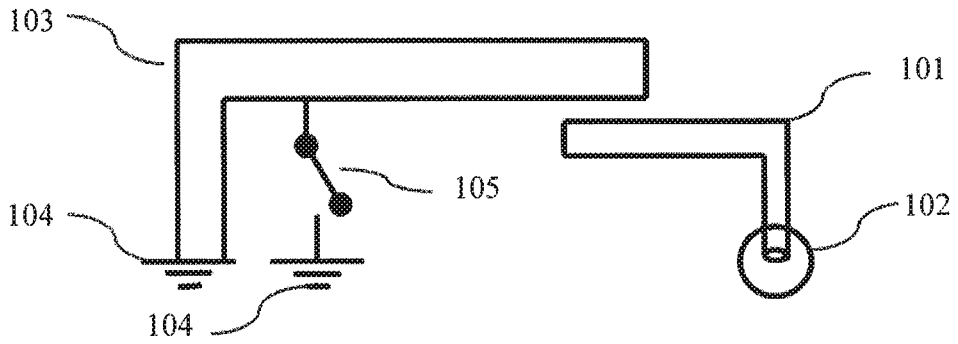
FIG. 1A is a schematic structural diagram of an antenna according to an embodiment of the present disclosure.

FIG. 1A is a schematic structural diagram of an antenna according to an embodiment of the present disclosure, where the antenna includes a feeding stub 101, a feeding point 102, and a coupling stub 103, where the coupling stub 103 includes at least two grounding points 104 (using two grounding points for description in this embodiment), the feeding stub 101 is electrically connected to the feeding point 102, the coupling stub 103 is coupled to the feeding stub 101, and one grounding point in the at least two grounding points is used for grounding, and the other grounding point or grounding points are selectively grounded or not grounded, or when one grounding point in the at least two grounding points is grounded, the other grounding point or grounding points are selectively grounded or not grounded.

It should be noted that, that one grounding point in the at least two grounding points is used for grounding means that the one grounding point is always grounded, and that when one grounding point in the at least two grounding points is grounded, the other grounding point or grounding points are selectively grounded or not grounded means that at least one grounding point in the at least two grounding points needs to be grounded, where the grounded grounding point may vary with different cases. Regardless of the case in which one grounding point is used for grounding or one grounding point is grounded, the purpose is that the coupling stub 103 is always electrically connected to the grounding point 104. It may be understood that, the case in which the grounding points are selectively grounded or not grounded may be implemented using a switch 105. Therefore, unless otherwise specified, an example in which the coupling stub 103 is selectively grounded using the switch 105 is used in the following embodiments.

Figure 1B:
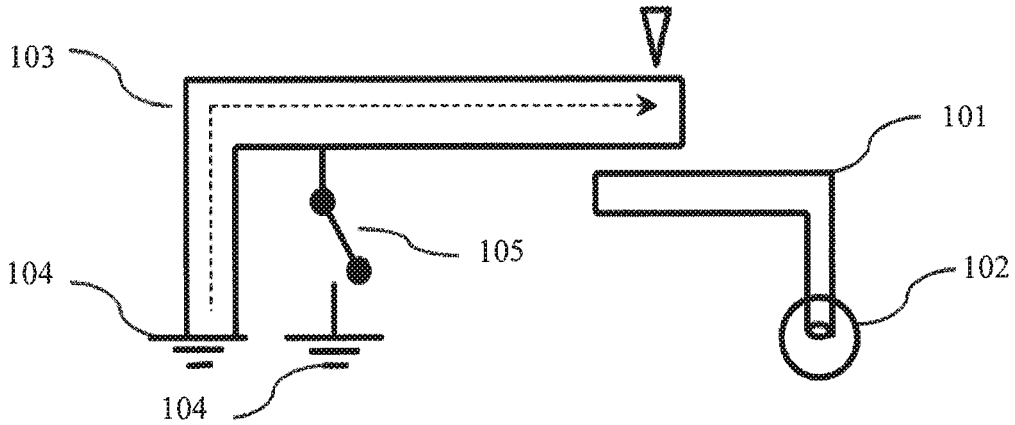
FIG. 1B is a schematic diagram of a current path in an antenna according to an embodiment of the present disclosure.
Figure 1C:
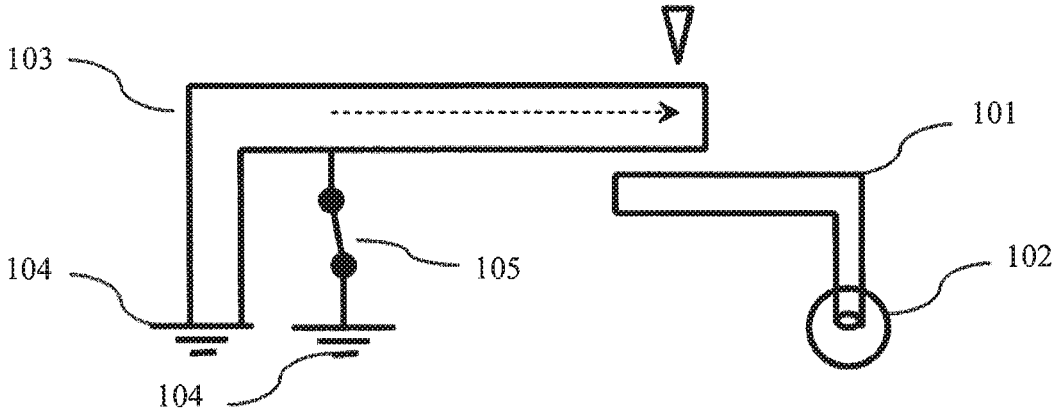
FIG. 1C is a schematic diagram of a current path in an antenna according to an embodiment of the present disclosure.
Figure 2A:
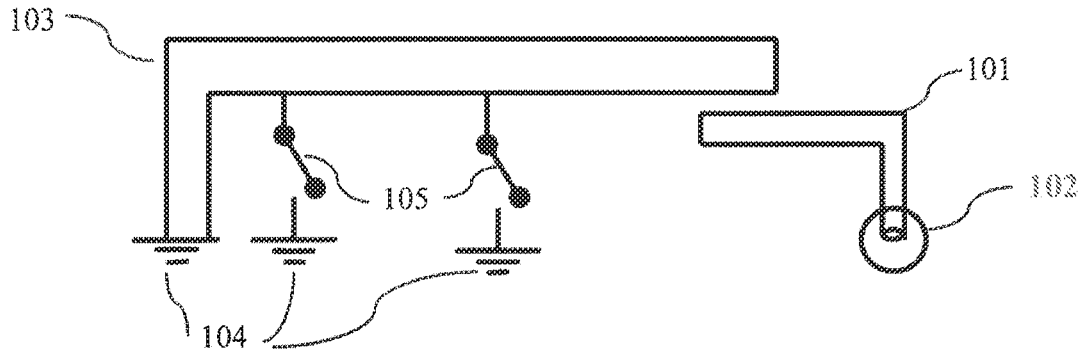
FIG. 2A is a schematic structural diagram of an antenna according to an embodiment of the present disclosure.
Figure 2B:
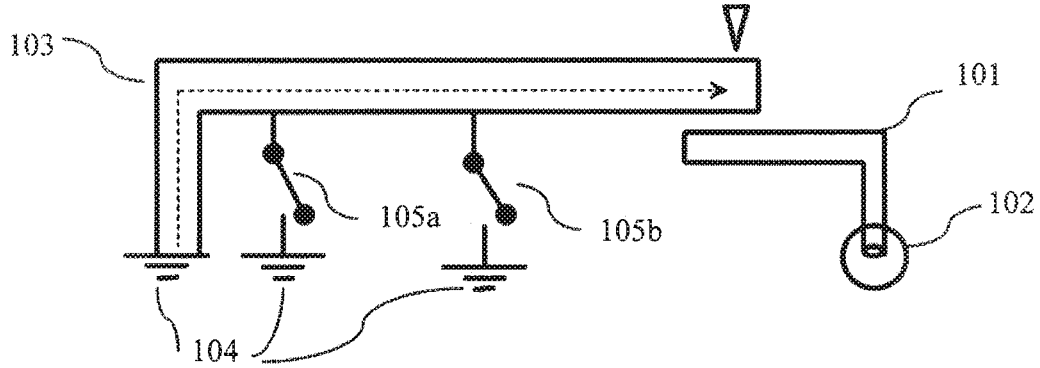
FIG. 2B is a schematic diagram of a current path in an antenna according to an embodiment of the present disclosure.
Figure 2C:
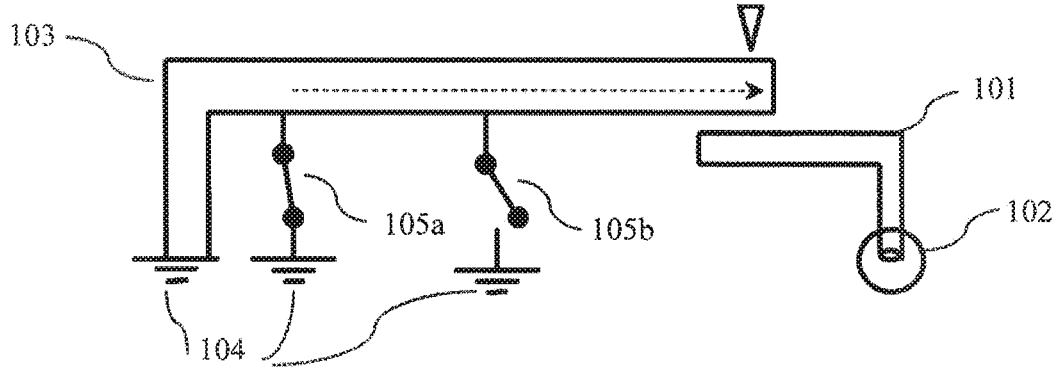
FIG. 2C is a schematic diagram of a current path in an antenna according to an embodiment of the present disclosure.

When there is only one switch 105 between the coupling stub 103 and the grounding point 104, the coupling stub 105 needs to be always electrically connected, in other positions (in this embodiment, using an end of the antenna as an example, where a meaning of the end will be further explained in the following text), to the grounding point 104 such that the coupling stub 103 is always electrically connected to the grounding point 104, that is, the case "one grounding point in the at least two grounding points is used for grounding" mentioned above. In this case, when the switch 105 is turned off, a current path is determined by an inherent structure of the antenna (that is, a dotted line in FIG. 1B shows a current path, and an arrow shows a current direction), after the switch 105 is turned on, a new grounding point is added to the coupling stub 103, and original electric field distribution is changed. Therefore, a new current path may be formed (a dotted line in FIG. 1C shows a new current path, and an arrow shows a direction of the current path). Because a length of the new current path is different from a length of an original current path, different resonance frequencies and working frequency bands of the antenna may be generated by coupling with the feeding stub 101, in addition, when positions of the switch 105 are different, new current paths also vary. Which specific position is selected may be determined, by means of debugging, according to factors such as a working frequency band required for working of the antenna. It may be understood that, this case may be extended to a case of multiple switches. Referring to FIG. 2A, as shown in the figure, a coupling stub 103 has one grounding point for grounding, and in addition, is selectively grounded using two switches 105. When both the two switches 105 are turned off, a length of a current path is determined by an inherent structure of an antenna (that is, a dotted line in FIG. 2B shows a current path, and an arrow shows a current direction), when a switch 105*a* is turned on and a switch 105*b* is turned off, the current path in the coupling stub 103 is changed (a dotted line in FIG. 2C shows a current path, and an arrow shows a current direction). If the statuses of the switches are further changed, the current path is further changed. Related content is not further described.

In a second case (referring to FIG. 3A), a coupling stub 103 does not have a position that always keeps an electrical connection with a grounding point 104. This requires that at least one switch 105 is in an on state in various cases in which switches 105 are turned on or off, that is, when one grounding point is grounded, the other grounding point or grounding points are selectively grounded or not grounded. It may be understood that, multiple switches 105 in different off and on states split the coupling stub 103 into different parts, that is, current paths of different lengths are formed on the coupling stub 103, for example, current paths corresponding to FIG. 3B (a switch 105*c* is turned on, and a switch 105*d* is turned off) and FIG. 3C (the switch 105*c* is turned off, and the switch 105*d* is turned on) are different. Therefore, couplings between the coupling stub 103 and a feeding stub 101 are changed, and a resonance frequency of the antenna and a corresponding working frequency band of the antenna are changed. Which specific position is selected may be determined, by means of debugging, according to factors such as a working frequency band required for working of the antenna.

Figure 3A:
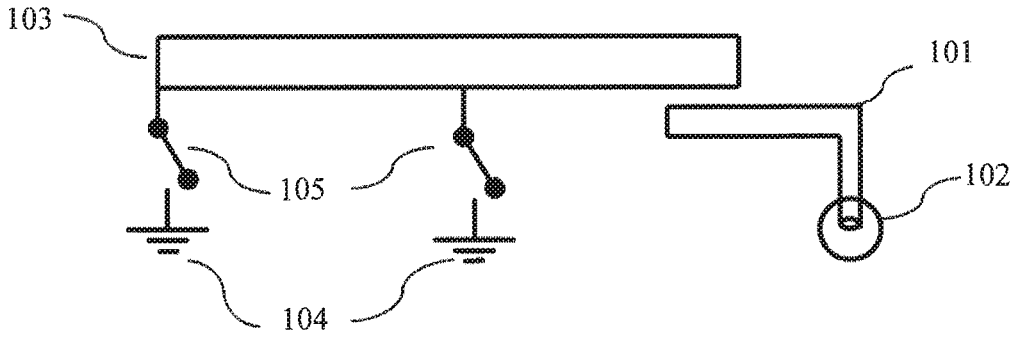
FIG. 3A is a schematic structural diagram of an antenna according to an embodiment of the present disclosure.
Figure 3B:
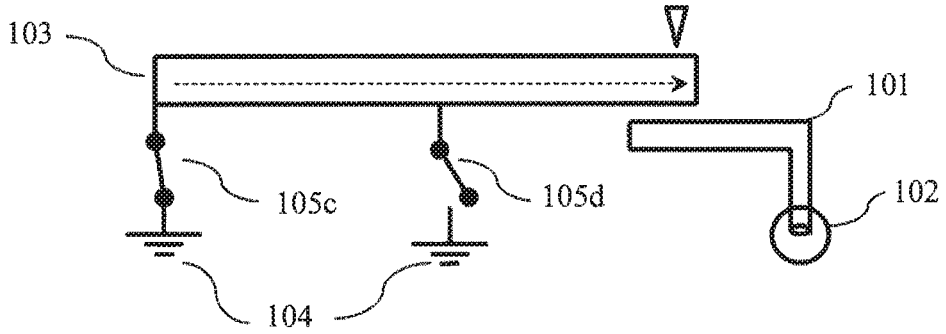
FIG. 3B is a schematic diagram of a current path in an antenna according to an embodiment of the present disclosure.
Figure 3C:
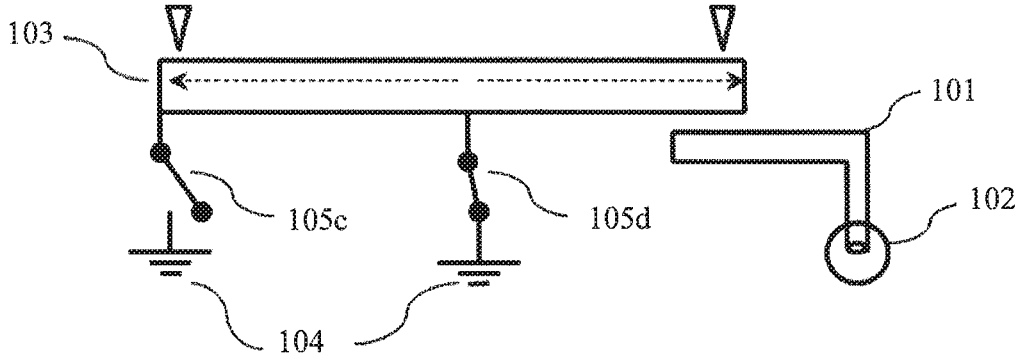
FIG. 3C is a schematic diagram of a current path in an antenna according to an embodiment of the present disclosure.

It should be noted that, when one grounding point of the coupling stub 103 is grounded, the one grounding point is preferably grounded at an end of the coupling stub 103, where the end (including places in which 103 and 104 are connected in FIG. 1A, FIG. 1B, FIG. 1C, FIG. 2A, FIG. 2B, and FIG. 2C) refers to a longest current path (such as the length of the dotted line in FIG. 1B and FIG. 2B) from the end to a farthest radiating point (positions shown by Δ in FIG. 1A and FIG. 2A are farthest radiating points, where Δ is used only to mark a position and is not a part of the structure of the antenna, and Δ in other drawings also indicate the same meaning) on the coupling stub 103 after a structure of the coupling stub 103 is determined. The reason for this selection is that the length of the current path and the resonance frequency of the antenna are negatively correlated. When the length of the current path is the longest, a generated resonance frequency is the lowest. If the end is not selected, but a position except the end of the coupling stub 103 is selected, it may be understood that, a length (such as the length of the dotted line in FIG. 1C and FIG. 2C) of a current path from the position except the end to any position on the coupling stub is less than the length of the current path from the end to the farthest radiating point. If the length of the current path is shorter, fewer low-frequency resonance frequencies can be generated, and a quantity of available working frequency bands of the whole antenna is reduced. This is equivalent to a waste of a section of the antenna length, which undoubtedly deviates from expectations for wide frequency bands and multiple frequencies. It may be understood that, when the coupling stub 103 is electrically connected to all the grounding points using multiple switches (as shown in FIG. 3A), one of the switches (such as 105*c* in FIG. 3A) may be preferably at the end of the coupling stub 103. Thereby, when this switch is turned on (referring to FIG. 3B), a longest current path (the length of the dotted line in FIG. 3B) may be generated on the coupling stub 103.

It should be noted that, adding a switch 105 to the coupling stub 103 may change the length of the current path on the coupling stub 103, and thereby change the resonance frequency of the antenna and the corresponding working frequency band of the antenna. In this case, an antenna clearance area needs only to meet a maximum value in clearance area requirements of the antenna that is before the change and after the change, that is, the antenna clearance area needs only to meet a maximum clearance area requirement. For example, if the coupling stub 103 has only one switch 105, assuming that when the switch 105 is turned off, the antenna can cover 698 MHz to 960 MHz and a clearance area of 7 mm is required, and that when the switch 105 is turned on, the antenna can cover 1710 MHz to 2700 MHz and a clearance area of 7.5 mm is required, thus only 7.5 mm is required for a clearance area of an entire antenna, in this case, when one antenna needs to cover the both frequency bands, the clearance area of the antenna does not need to be added to more than 10 mm. The antenna has a corresponding clearance area requirement when working in each working frequency band, and may correspond to different clearance area requirements when working in different working frequency bands, where a maximum value in the clearance area requirements is the maximum clearance area requirement.

Further, to reduce interference from an external signal on working of the antenna, the feeding stub 101 may be connected to a feeder (feeder) using a feeding point. The feeder refers to a transmission line feeding electric energy to the antenna. Compared with an ordinary conductor, the feeder causes little high-frequency attenuation to a received signal, has strong interference immunity, and is not vulnerable to interference from an external high-frequency signal. When sending a signal, an output end of a radio frequency chip transmits electric energy to the feeding stub 101 using the feeder, and the antenna converts the electric energy into an electromagnetic wave that may propagate in free space, when receiving a signal, an input end of the radio frequency chip receives an electromagnetic wave, in the free space, captured by the feeder from the antenna. It may be understood that, the radio frequency chip mentioned above may also be replaced with a combination of discrete components, and may further include a filter circuit, a power amplification circuit, a modulation and demodulation circuit, and the like.

Figure 4:
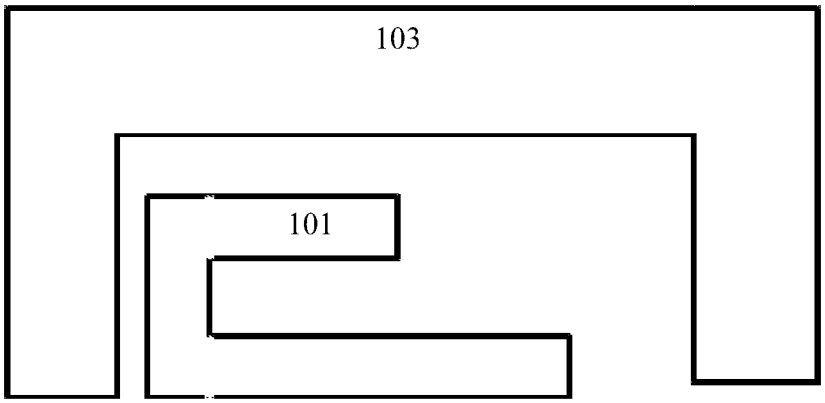
FIG. 4 is a schematic structural diagram of an antenna according to an embodiment of the present disclosure.
Figure 5:
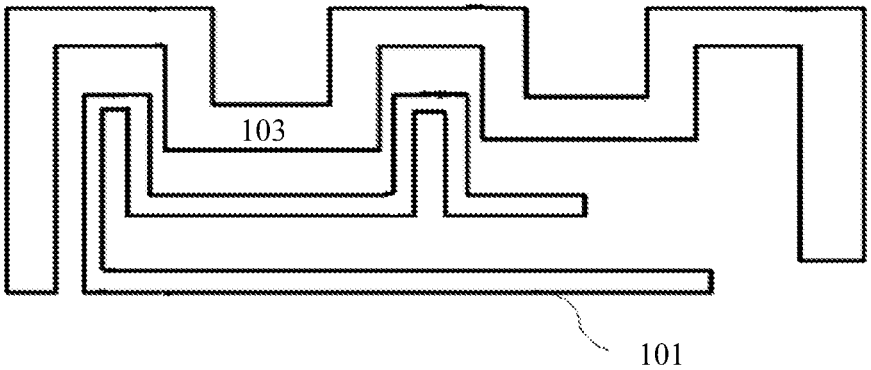
FIG. 5 is a schematic structural diagram of an antenna according to an embodiment of the present disclosure.

In the embodiment of the present disclosure, no limitation is imposed on shapes of the coupling stub 103 and the feeding stub 101. The shapes may be the forms in FIG. 1A to FIG. 3A, or a feeding stub 101 takes on a reverse U shape while a coupling stub 103 takes on a Π-shape and half-encloses the feeding stub (as shown in FIG. 4). A feeding stub 101 and a coupling stub 103 may also use a meander antenna form (as shown in FIG. 5). Different antenna forms may be used to increase or weaken couplings between the coupling stub 103 and the feeding stub 101, and therefore a required working frequency band of the antenna is obtained.

Figure 6:
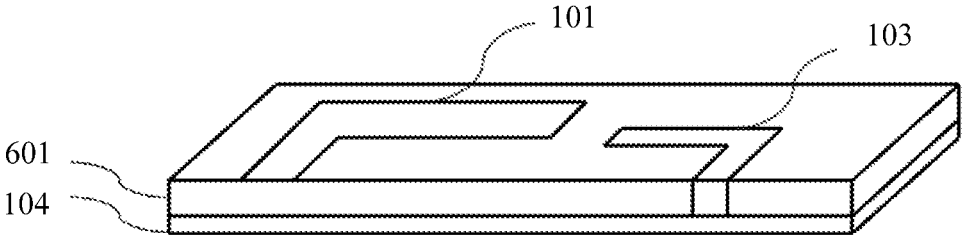
FIG. 6 is a schematic diagram in which a feeding stub and a coupling stub are attached to a dielectric substrate according to an embodiment of the present disclosure.

Air may be used as a dielectric between planes (generally a printed circuit board in which a main board is located) on which the feeding stub 101, the coupling stub 103, and the grounding point 104 are located. Further, to reduce a size of the antenna, the feeding stub 101 and the coupling stub 103 may be attached to a dielectric substrate 601 (referring to FIG. 6), where a dielectric constant of the dielectric substrate 601 is greater than a dielectric constant of the air. Materials of the dielectric substrate 601 may include plastic, glass, and ceramic, or include composite materials such as silicon or hydrocarbon. In application environments of mobile terminals such as a mobile phone, a thickness of the dielectric substrate 601 is about several millimeters.

Optionally, the feeding stub 101 and the coupling stub 103 may both be made of metal materials, where the metal materials include copper, aluminum, plating, and the like.

Optionally, a laser direct structuring technology or another technology may be used to attach the feeding stub 101 and the coupling stub 103 to the dielectric substrate 601, or an adhesive or another manner may be used to attach the feeding stub 101 and the coupling stub 103 to the dielectric substrate 601.

Optionally, a manner of electrically connecting the coupling stub 103 and the grounding point may be a connection manner using a metal dome, a welding manner, or another connection manner.

Figure 7A:
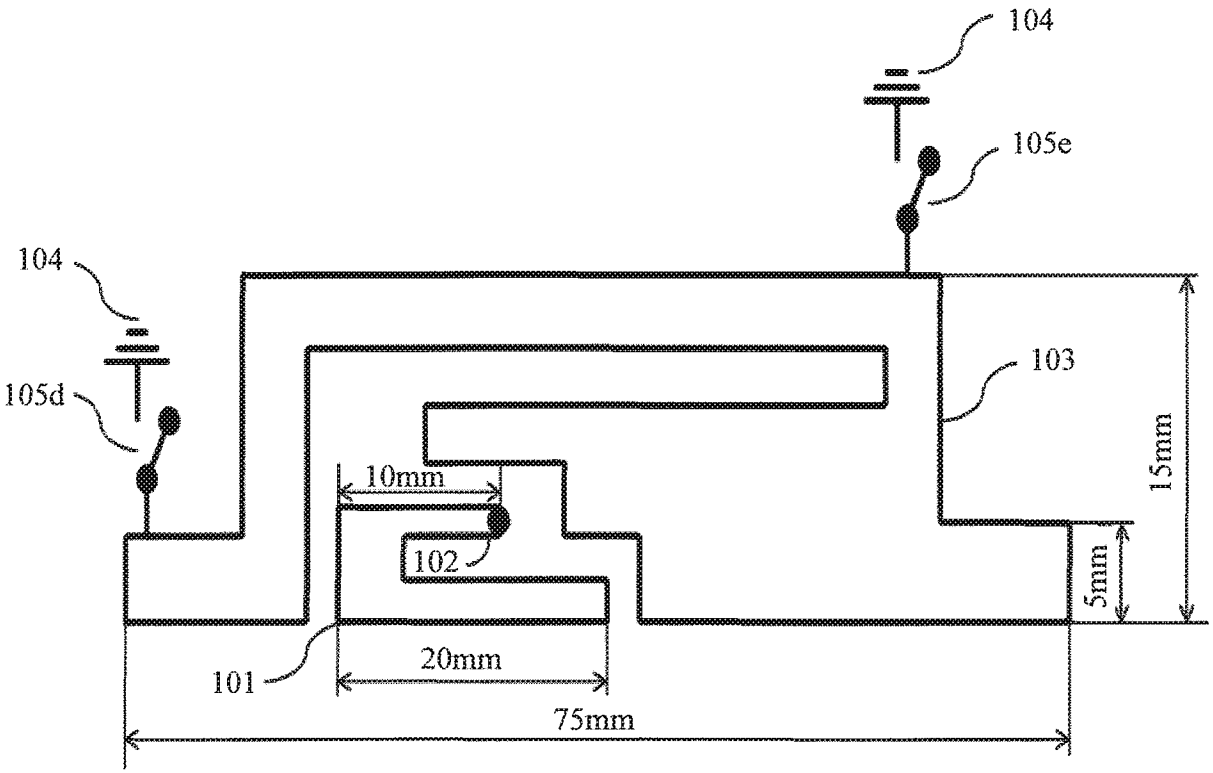
FIG. 7A is a schematic structural diagram of an antenna according to an embodiment of the present disclosure.

In FIG. 7A, a specific embodiment is used to describe an antenna provided by an embodiment of the present disclosure, where the antenna may cover multiple working frequency bands without increasing a clearance area, and the antenna includes a feeding stub 101 and a feeding point 102.

Figure 7B:
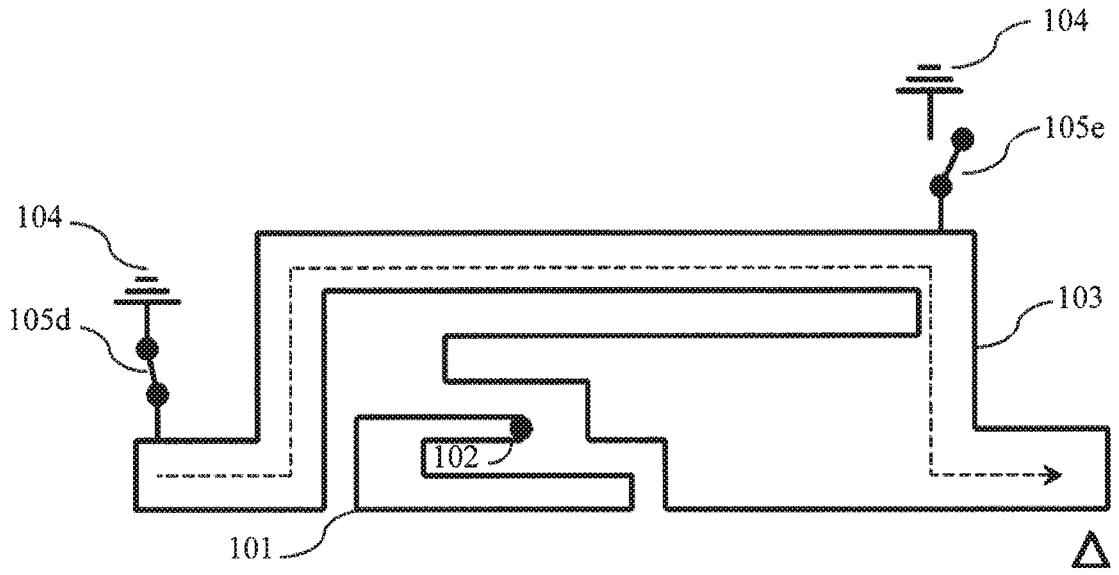
FIG. 7B is a schematic diagram of a current path in an antenna according to an embodiment of the present disclosure.

The feeding stub 101 is electrically connected to the feeding point 102, where the feeding stub 101 takes on a reverse U shape, a coupling stub 103 is coupled to the feeding stub 101, where the coupling stub 103 takes on an approximate Π-shape, the coupling stub 103 half-encloses the feeding stub 101, the coupling stub 103 is electrically connected to grounding points 104 using switches 105*d* and 105*e*, when one switch is turned on, the other switch is turned off. In the embodiment of the present disclosure, an antenna clearance area is 7 mm, and a length of the feeding stub 101 is about 35 mm, a main resonance frequency is about 2100 MHz, the switch 105*d* is located at an end of the coupling stub 103, when the switch 105*d* is turned on, and the switch 105*e* is turned off, a current has a longest effective current path on the coupling stub 103 (referring to FIG. 7B). As shown in the figure, the longest effective current path is about 105 mm, and the resonance frequency of the antenna is about 700 MHz. A table of actually measured S11 is as follows:

TABLE 1

| Frequency (MHz) | S11 (dB) |
|---|---|
| 678 | −5.3 |
| 704 | −5.8 |
| 746 | −5.2 |

S11 indicates return loss characteristics, and is a common parameter for evaluating efficiency of the antenna. A smaller parameter value indicates less reflected energy, and therefore efficiency of the antenna is higher. Generally, in a case of an electrically small antenna, a value of S11 should be less than −5 decibel (dB).

Therefore, as may be known from the actually measured data, in a frequency band of 678 MHz to 746 MHz, all values of 511 are less than −5 dB. Therefore, in this case, a range in which the antenna works efficiently covers 678 MHz to 746 MHz.

Figure 7C:
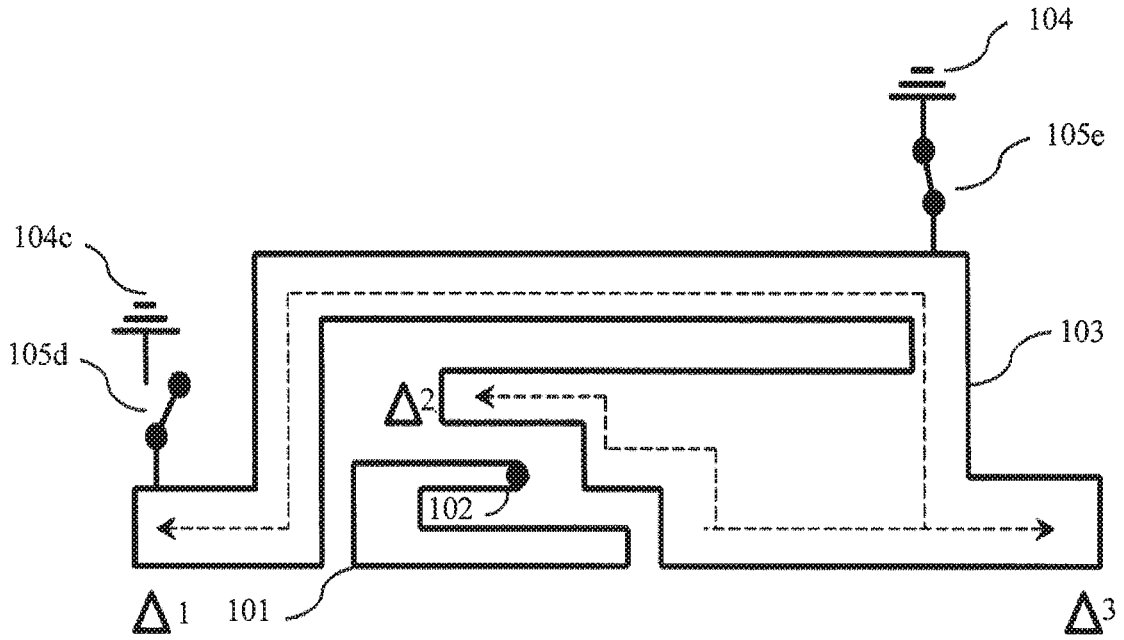
FIG. 7C is a schematic diagram of a current path in an antenna according to an embodiment of the present disclosure.

When the switch 105*d* is turned off, and the switch 105*e* is turned on (referring to FIG. 7C), on the coupling stub 103, a current in the position of the switch 105*e* is maximal, and the current path on the entire coupling stub 103 is changed, and may be approximately abstracted into three current paths. A length corresponding to a current path 1 (from the switch 105*e* to a radiating point Δ1) is about 80 mm, and a resonance frequency corresponding to the current path is about 850 MHz. A length corresponding to a current path 2 (from the switch 105*e* to a radiating point Δ2) is about 37 mm, and a resonance frequency corresponding to the current path is about 1800 MHz. A length corresponding to a current path 3 (from the switch 105*e* to a radiating point Δ3) is about 25 mm, and a resonance frequency corresponding to the current path is about 2500 MHz.

A table of actually measured S11 is as follows:

TABLE 2

| Frequency (MHz) | S11 (dB) |
|---|---|
| 791 | −5.4 |
| 824 | −11.7 |
| 960 | −5.5 |
| 1710 | −9.7 |
| 1920 | −19.0 |
| 2170 | −15.1 |
| 2500 | −5.1 |
| 2690 | −7.9 |

As may be known from the actually measured data, in this case, a range in which the antenna efficiently works is 790 MHz to 960 MHz and 1710 MHz to 2700 MHz.

In conclusion, according to the antenna in the embodiment of the present disclosure, if an antenna clearance area of only 7 mm is required, frequencies from 678 MHz to 960 MHz and from 1710 MHz to 2700 MHz are basically covered.

Figure 8:
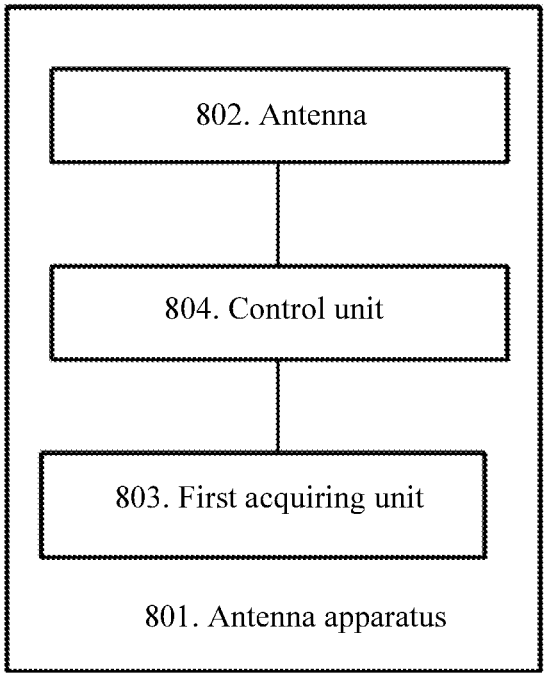
FIG. 8 is a schematic diagram of an antenna apparatus according to an embodiment of the present disclosure.

Further, FIG. 8 shows an antenna apparatus 801 provided by an embodiment of the present disclosure. The antenna apparatus 801 includes an antenna 802, a first acquiring unit 803, and a control unit 804. The first acquiring unit 803 is electrically connected to the control unit 804, and the control unit 804 is electrically connected to the antenna 802. The antenna 802 includes a feeding point, a feeding stub, and a coupling stub, where the feeding stub is electrically connected to the feeding point, the coupling stub is coupled to the feeding stub, the coupling stub includes at least two grounding points, where one grounding point in the at least two grounding points is used for grounding, and the other grounding point or grounding points are selectively grounded or not grounded, or when one grounding point in the at least two grounding points is grounded, the other grounding point or grounding points are selectively grounded or not grounded. The first acquiring unit 803 is configured to acquire a target working frequency band, the control unit 804 is configured to adjust a grounding combination of the antenna 802 according to the target working frequency band, and the grounding combination includes a combination in which the at least two grounding points are grounded or not grounded.

The first acquiring unit 803 may be a user input apparatus, for example, a touch screen. The control unit 803 may be a processor, for example, a processor of a terminal. In an optional manner, the antenna apparatus further includes a storage unit, where the storage unit is electrically connected to the control unit, that is, data can be transmitted between the storage unit and the control unit, and the storage unit is configured to store a grounding status table, where the grounding status table records a correspondence between a grounding combination and a working frequency band of the antenna, and the adjusting a grounding combination of the antenna according to the target working frequency band specifically includes finding the corresponding working frequency band of the antenna in the grounding status table according to the target working frequency band, and selecting the grounding point combination according to the correspondence between the grounding combination and the working frequency band of the antenna that is recorded in the grounding status table. The storage unit may be a memory of the terminal, the correspondence includes a case in which the working frequency band of the antenna and the target working frequency band are the same or approximate.

Furthermore, still using a manner of selectively grounding using a switch, as an example, during antenna design and production, working frequency bands, of the antenna, corresponding to statues of different switches are recorded in the grounding status table. Then during use, a working frequency band provided by an operator is acquired, a working frequency band of the antenna in the grounding status table is found correspondingly, then a status of a switch is selected according to a correspondence between working frequency bands of the antenna in the grounding status table and the statuses of the switches. The terminal in which the antenna is located may also preset and update a working frequency band table, where the table records a correspondence between different operators and working frequency bands provided by the operators. Exemplarily, the foregoing method is further described with reference to Table 3.

TABLE 3

| Working frequency band table | | | Grounding status table | |
|---|---|---|---|---|
| Operators | Working frequency bands provided by operators (MHz) | | Working frequency bands of an antenna (MHz) | Switch statuses |
| NTT docomo | 1450 to 1520 | | 1450 to 1520 | Switch 1 is turned off, switch 2 is turned on. |
| NTT docomo | 1920 to 1980, and 2110 to 2170 | | 1920 to 1980, and 2110 to 2170 | Switch 1 is turned on, switch 2 is turned off. |
| Operator B | 700-800 | | 700-800 | Switch 1 is turned on, switch 2 is turned on. |

In Table 3, recorded frequency bands of Nippon Telegraph and Telephone Corporation (NTT) DOCOMO are 1450 MHz to 1520 MHz and 1920 MHz to 1980 MHz and 2110 MHz to 2170 MHz, working frequency bands of operator B are 700 to 800 MHz, the working frequency band table may be stored in the memory of the terminal, where data in the working frequency band table may be preset during production, or updated data may be received from a network side after sale, and data changed by the operators is added to the table during an update. There is another grounding status table in the terminal. This table records different working frequency bands of the antenna corresponding to combinations (equivalent to grounding combinations) of statuses of different switches. For example, the following are recorded in the grounding status table a working frequency band 1450 MHz to 1520 MHz of the antenna corresponds to a combination (equivalent to a grounding combination 1) in which a switch 1 is turned off and a switch 2 is turned on, working frequency bands 1920 MHz to 1980 MHz and 2110 MHz to 2170 MHz of the antenna correspond to a combination (equivalent to a grounding combination 2) in which the switch 1 is turned on and the switch 2 is turned off, and working frequency bands 1920 MHz to 1980 MHz and 700 to 850 MHz of the antenna correspond to a combination (equivalent to a grounding combination 3) in which both the switch 1 and the switch 2 are turned on. When knowing a working frequency band provided by an operator in a current position, the terminal may find a corresponding working frequency band of the antenna in the grounding status table according to the working frequency band provided by the operator, and then select to turn on or off appropriate switches (namely, a grounding combination) according to the correspondence between the working frequency bands of the antenna and the combinations of the switches that are turned on or off. For example, when needing to work in the frequency band 1450 MHz to 1520 MHz of NTT DOCOMO, the terminal finds a working frequency band of the antenna that is the same as the frequency band, and then determines that the switch 1 is turned off and that the switch 2 is turned on, when needing to work in the frequency bands 1920 MHz to 1980 MHz and 2110 MHz to 2170 MHz of NTT DOCOMO, the terminal finds the working frequency bands that are the same as the frequency bands, and then determines that the switch 1 is turned on and that the switch 2 is turned off, when the working frequency band provided by operator B is 700 MHz to 800 MHz, although the grounding status table does not record a working frequency of the antenna that is completely the same as the working frequency band, there is one working frequency band 700 MHz to 850 MHz of the antenna, which may cover the working frequency band of operator B, and therefore, the terminal selects to turn on both the switch 1 and the switch 2. Furthermore, during antenna design and production, a person skilled in the art may determine which working frequency band of the antenna corresponds to different switches that are turned on or off. Therefore, information of the grounding status table is already set before delivery, and does not need to be updated after delivery. The grounding status table may also be stored in the memory of the terminal.

In the embodiment of the present disclosure, the first acquiring unit may be a user input apparatus, for example, a touch screen, and that the first acquiring unit acquires a target working frequency band specifically includes acquiring a working frequency band of an operator according to a selection made by a user at discretion in the user input device. However, the method for obtaining a working frequency band of an operator includes that a user may select an operator and thereby determine, according to the working frequency band table, the working frequency band provided by the operator, and no limitation is set thereto in the present disclosure.

Further, the antenna apparatus includes a second acquiring unit, where the second acquiring unit is electrically connected to the control unit, and the second acquiring unit is configured to acquire a holding status of a user, the grounding status table further records a correspondence among the working frequency band of the antenna, the holding status, and the grounding combination, the control unit is further configured to adjust the working frequency band of the antenna according to the target working frequency band and the holding status of the user, and the adjusting the working frequency band of the antenna according to the target working frequency band and the holding status of the user specifically includes finding the corresponding working frequency band of the antenna in the grounding status table according to the target working frequency band and the holding status, and selecting the grounding combination according to the correspondence among the working frequency band of the antenna, the holding status, and the grounding combination that is recorded in the grounding status table. The second acquiring unit is a user input apparatus, and acquiring, by the second acquiring unit, a holding status of a user specifically includes acquiring the holding status according to a selection made by the user at discretion in the user input apparatus, or the second acquiring unit is a sensor, and the acquiring, by the second acquiring unit, a holding status of a user specifically includes determining, by the sensor, the holding status according to hand holding, or determine, by the sensor, the holding status according to a slide trace of a finger. The holding status includes left-hand holding, right-hand holding, backhand holding, forehand holding, and the like.

Figure 9:
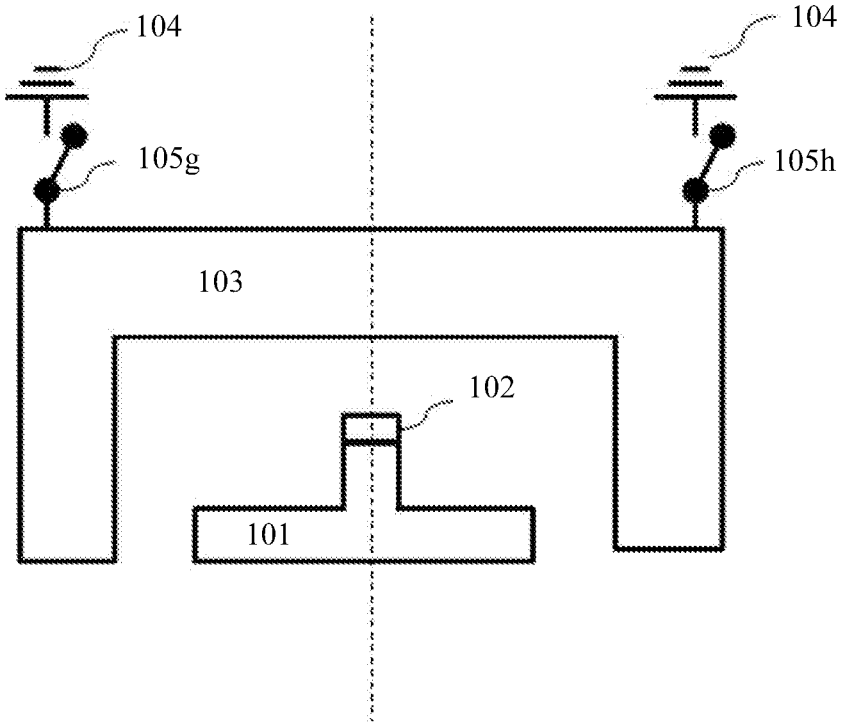
FIG. 9 is a schematic structural diagram of an antenna according to an embodiment of the present disclosure.

In the following example, an antenna shown in FIG. 9 is used as the antenna of the antenna apparatus in the embodiment of the present disclosure, where the antenna includes a feeding stub 101 and a feeding point 102.

The feeding stub 101 is electrically connected to the feeding point 102, a coupling stub 103 is coupled to the feeding stub 101, where the coupling stub 103 and the feeding stub 101 are both in a left-right symmetry form, the coupling stub 103 and the feeding stub 101 have a same axis of symmetry (as shown by a dotted line in the figure), the feeding point 102 is located on the axis of symmetry of the coupling stub 103 and the feeding stub 101, the coupling stub 103 is electrically connected to grounding points 104 using two switches 105*g* and 105*h*, when one switch is turned on, the other switch is turned off, and the two switches 105*g* and 105*h* are also disposed in positions that are symmetric about the axis of symmetry. With reference to the antenna, an embodiment of another antenna apparatus is provided.

It should be noted that, the symmetric manner of the antenna shown in the figure is only exemplary. A person skilled in the art can easily have an idea of making variations to the antenna form.

In the embodiment of the present disclosure, positions of the feeding stub 101, the coupling stub 103, and two switches 105*g* and 105*h* are all disposed to be symmetric about a same axis of symmetry. The antenna obtained in this manner is easily used to analyze impact of left-hand holding and right-hand holding on antenna performance. Furthermore, during design and debugging of a mobile phone, statuses of different switches are determined when left and right hands hold the mobile phone respectively so that efficiency of the antenna is the same or approximate. For example, during design and debugging, it is found that, when a right hand holds the mobile phone, the switch 105*g* is turned off, the switch 105*h* is turned on, and performance of the antenna is good, correspondingly recording the combination in which the switch 105*g* is turned off and the switch 105*h* is turned on as a combination of statuses of switches during holding performed by the right hand, and that when a left hand holds the mobile phone, the switch 105*g* is turned on, the switch 105*h* is turned off, and efficiency of the antenna can also achieve the effect that is achieved when the switch 105*g* is turned off and the switch 105*h* is turned on during holding performed by the right hand, correspondingly recording the case as a case of a combination of statuses of switches during holding performed by the left hand. The foregoing information is stored in the memory of the mobile phone. When using the mobile phone, a user may directly enter the holding status of left and right hands in an input apparatus, or may determine the holding status of left and right hands using a sensor or in another manner, or determine the holding status of left and right hands according to a slide trace of a finger, or the like. After left-hand holding or right-hand holding is recognized, a corresponding grounding combination is selected according to the foregoing correspondence among the working frequency band of the antenna, the holding status, and the grounding combination that is recorded in the grounding status table.

TABLE 4

| Working frequency band table | | | Grounding status table | | |
|---|---|---|---|---|---|
| Operator | Working frequency band provided by the operator (MHz) | ⇔ | Working frequency band of the antenna (MHz) | Holding status of left/right hand | Switch statuses |
| | | | 700 to 800 | Right hand | Switch combination 1 |
| Operator B | 700-800 | | 700 to 800 | Left hand | Switch combination 2 |

It may be understood that, although a symmetric manner is used as an example in the embodiment of the present disclosure, in an asymmetric antenna form, statuses of different switches corresponding to the same or approximate effect reached during left-hand holding and right-hand holding may also be preferably selected during design and debugging, and then the preferably selected cases of combinations in which the switches are turned on or off are recorded into the memory. When the user uses the mobile phone, the user acquires, from the memory according to the above-mentioned method for recognizing left-hand holding and right-hand holding, a preferred combination in which the switches are turned on or off, and performs a corresponding operation. With reference to Table 4, it may be further noted that, for example, during design and debugging, when it is found that, when the working frequency band of the antenna is 700 MHz to 800 MHz, and the mobile phone is held in a right hand, an effect of the working frequency band corresponding to a switch combination 1 is good, and when the mobile phone is held in a left hand, an effect corresponding to a switch combination 2 is good. Therefore, the working frequency band of the antenna, the left-hand holding status, the right-hand holding status, and the corresponding switch statuses are all recorded in the grounding status table. During actual use, when the acquired working frequency band of the operator B is 700 MHz to 800 MHz, a case in which the working frequency band of the antenna is 700 MHz to 800 MHz is found in the grounding status table, and then the left-hand holding status or right-hand holding status is determined. With reference to the working frequency band of the antenna, the left-hand holding status, and the right-hand holding status, a corresponding switch combination is found. Thereby, regardless of whether the user uses the left hand or the right hand for holding, the antenna has good efficiency.

Figure 10:
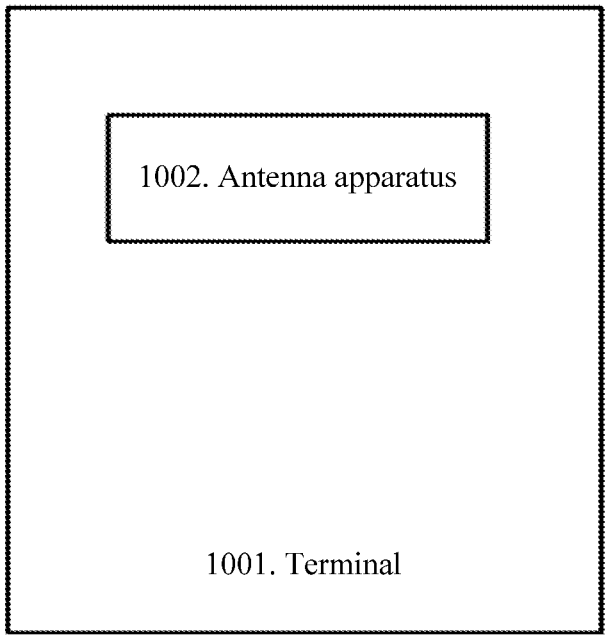
FIG. 10 is a schematic block diagram of a terminal according to an embodiment of the present disclosure.

FIG. 10 shows a terminal provided by an embodiment of the present disclosure.

The terminal includes a body 1001 and an antenna apparatus 1002, where the antenna apparatus 1002 is disposed on the body 1001 of the terminal. The antenna apparatus includes the first acquiring unit, the control unit, the antenna, or the second acquiring unit, and the storage unit mentioned in the foregoing embodiments, and the like. The first acquiring unit may be a user input apparatus, the control unit may be a processor, the second acquiring unit may be a user input apparatus, a sensor, or the like, and the storage unit may be a memory.

When the terminal is a hand-held terminal, the antenna may be located in a side elevation at the bottom of the hand-held terminal in order to reduce impact of contact between the terminal and a head or hand, where the feeding point is located in the middle of the side elevation at the bottom. It may be understood that, because the feeding point is located in the middle of the side elevation at the bottom, impact of contact between the terminal and the head or the left or right hand may be reduced effectively such that the antenna retains relatively high work efficiency.

According to the antenna provided in this embodiment of the present disclosure, switches are added in different positions on a coupling stub such that a current path length of a current in the coupling stub is changed, that is, a resonance frequency of the antenna and a corresponding working frequency band are changed. Because different cases of switches are selected and corresponding to different working frequency bands, an antenna clearance area only needs to meet a maximum clearance area requirement in various cases of switches, and does not need to reach clearance area requirements that are when the antenna can work in all working frequency bands, in this case, the clearance area does not need to be increased while multi-frequency coverage of the antenna is implemented.

Figure 11:
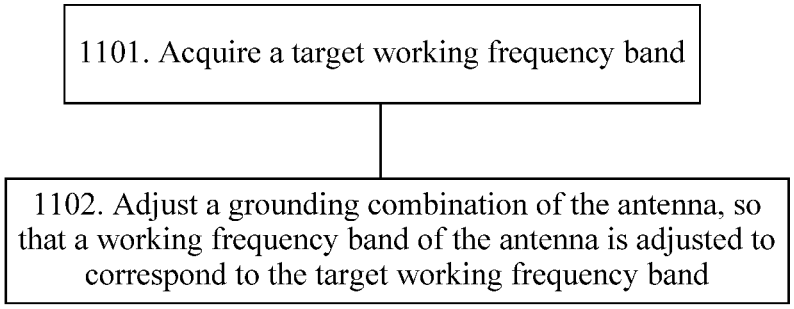
FIG. 11 is a flowchart of a method according to an embodiment of the present disclosure.

FIG. 11 shows a method for adjusting a working frequency band of an antenna according to another embodiment of the present disclosure. At step 1101, acquiring a target working frequency band. At step 1102, adjusting a grounding combination of the antenna such that the working frequency band of the antenna is adjusted to correspond to the target working frequency band.

Optionally, the antenna includes at least two grounding points, where one grounding point in the at least two grounding points is used for grounding, or when one grounding point in the at least two grounding points is grounded, the other grounding point or grounding points are selectively grounded or not grounded. Optionally, the adjusting a grounding combination of the antenna such that the working frequency band of the antenna is adjusted to correspond to the target working frequency band, specifically includes presetting a grounding status table in a terminal in which the antenna is located, where the grounding status table records a correspondence between the grounding combination and the working frequency band of the antenna, and the grounding combination includes a combination in which the at least two grounding points are grounded or not grounded, and finding the corresponding working frequency band of the antenna in the grounding status table according to the target working frequency band, and selecting the grounding combination according to the correspondence between the grounding combination and the working frequency band of the antenna that is recorded in the grounding status table. Furthermore, the grounding combination includes a combination in which the at least two grounding points are grounded or not grounded.

Further, the method includes acquiring a holding status of a user, including forehand holding, backhand holding, left-hand holding, right-hand holding, and the like. Optionally, the grounding status table further records a correspondence among the working frequency band of the antenna, the holding status, and the grounding combination, and the corresponding working frequency band of the antenna is found in the grounding status table according to the target working frequency band and the holding status, and the grounding combination is selected according to the correspondence recorded in the grounding status table.

Optionally, the acquiring a holding status includes acquiring the holding status according to a selection made by the user at discretion, or determining, by a sensor, the holding status according to hand holding, or determining, by a sensor, the holding status according to a slide trace of a finger, or the like.

Optionally, the acquiring a target working frequency band includes acquiring a working frequency band of an operator according to a selection made by the user at discretion.

According to the method provided by the embodiment of the present disclosure, an appropriate grounding status is selected after a target working frequency band of an antenna is acquired such that a working frequency band of the antenna is adjusted to correspond to the target working frequency band. Furthermore, switches are added in different positions in the antenna, a current path length of a current in the antenna is changed, that is, a resonance frequency of the antenna and the corresponding working frequency band are changed. Because different grounding combinations are selected and corresponding to different working frequency bands, an antenna clearance area only needs to meet a maximum clearance area requirement in various cases of switches, and does not need to reach clearance area requirements that are when the antenna can work in all working frequency bands, in this case, the clearance area does not need to be increased while multi-frequency coverage of the antenna is implemented.

In the foregoing embodiments, the description of each embodiment has respective focuses. For a part that is not described in detail in an embodiment, reference may be made to related descriptions in other embodiments.

It should be noted that in this specification, relational terms such as first and second are only used to distinguish one entity or operation from another, and do not necessarily require or imply that any actual relationship or sequence exists between these entities or operations.

It should be noted that, the "unit" mentioned in some embodiments of the present disclosure is a combination of hardware and/or software that may implement corresponding functions, that is, an implementation manner of hardware, software, or a combination of software and hardware may be conceived.

It should be noted that, the foregoing electrical connection manner includes a manner of direct physical contact or electrical contact between different units, or includes transmitting an electrical signal although there is no direct physical contact or electrical contact between different units.

The foregoing descriptions are merely specific implementation manners of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. An antenna apparatus, comprising:

an antenna comprising:

a feeding point;

a feeding stub electrically connected to the feeding point; and an L-shaped coupling stub coupled to the feeding stub, wherein the L-shaped coupling stub consists of:

a first arm having a longest dimension in a first direction, wherein all of the first arm extends only in the first direction;

a second arm coupled to the first arm and having a longest dimension in a second direction that is perpendicular to the first direction, wherein all of the second arm extends only in the second direction; and multiple grounding points including a plurality of first grounding points and a second grounding point, wherein the first grounding points are located on the first arm, wherein the second grounding point is located on the second arm, and wherein one of the first grounding point is configurable for selective grounding;

a first data acquirer configured to acquire a target working frequency band; and a processor coupled to the antenna and the first data acquirer and configured to adjust a first grounding combination of the antenna according to the target working frequency band, the first grounding combination comprising a combination of grounding statuses of the multiple grounding points.

2. The antenna apparatus of claim 1, further comprising a memory configured to store a grounding status table that records a first correspondence between a second grounding combination and a working frequency band of the antenna, and the processor being further configured to adjust the first grounding combination of the antenna according to the target working frequency band by:

finding a corresponding working frequency band of the antenna in the grounding status table according to the target working frequency band; and selecting the second grounding combination according to the first correspondence between the second grounding combination and the working frequency band of the antenna that is recorded in the grounding status table for adjusting the first grounding combination of the antenna.

3. The antenna apparatus of claim 2, further comprising a second data acquirer electrically connected to the processor and configured to acquire a holding status of a user, wherein the grounding status table further records a second correspondence among the working frequency band of the antenna, the holding status, and the second grounding combination, and the processor is further configured to adjust the first grounding combination of the antenna according to the target working frequency band and the holding status of the user by:

finding the corresponding working frequency band of the antenna in the grounding status table according to the target working frequency band and the holding status; and selecting the second grounding combination according to the second correspondence among the working frequency band of the antenna, the holding status, and the second grounding combination that is recorded in the grounding status table for adjusting the first grounding combination of the antenna.

4. The antenna apparatus of claim 3, wherein the second data acquirer comprises a user input apparatus configured to acquire the holding status of the user according to a selection made by the user at the user input apparatus.

5. The antenna apparatus of claim 3, wherein the second data acquirer comprises a sensor configured to acquire the holding status of the user according to hand holding.

6. The antenna apparatus of claim 3, wherein the second data acquirer comprises a sensor configured to acquire the holding status of the user according to a slide trace of a finger.

7. The antenna apparatus of claim 1, further comprising a switch coupled to a first grounding point and configured to selectively ground the first grounding point, and wherein the second grounding point is directly connected to ground.

8. The antenna apparatus of claim 1, further comprising:

a plurality of first switches coupled to a plurality of the first grounding points and configured to connect the first grounding points to ground.

9. The antenna apparatus of claim 1, wherein a first grounding point is located at an end of the first arm of the L-shaped coupling stub, and wherein a current path from the end to a farthest radiating point on the L-shaped coupling stub is longest.

10. The antenna apparatus of claim 1, wherein the first data acquirer comprises a user input apparatus configured to acquire the target working frequency band by acquiring a working frequency band of an operator according to a selection made by a user at the user input apparatus.

11. A terminal comprising:

a body; and an antenna apparatus disposed on the body and comprising:

an antenna comprising:

a feeding point;

a feeding stub electrically connected to the feeding point; and an L-shaped coupling stub coupled to the feeding stub, wherein the L-shaped coupling stub consists of:

a first arm having a longest dimension in a first direction, wherein all of the first arm extends only in the first direction;

a second arm coupled to the first portion and having a longest dimension in a second direction that is perpendicular to the first direction, wherein all of the second arm extends only in the second direction; and multiple grounding points including a plurality of first grounding points and a second grounding point, wherein the first grounding points are located on the first arm, wherein the second grounding point is located on the second arm, and wherein one of the first points is configurable for selective grounding;

a first data acquirer configured to acquire a target working frequency band; and a processor coupled to the antenna and the first data acquirer and configured to adjust a grounding combination of the antenna according to the target working frequency band, wherein the grounding combination comprises a combination of grounding statuses of the multiple grounding points.

12. A terminal comprising:

an antenna comprising:

a feeding point;

a feeding stub electrically connected to the feeding point; and an L-shaped coupling stub coupled to the feeding stub, wherein the L-shaped coupling stub consists of:

a first arm having a longest dimension in a first direction;

a second arm coupled to the first arm and having a longest dimension in a second direction that is perpendicular to the first direction; and multiple grounding points including a plurality of first grounding points and a second grounding point, wherein the first grounding points are located on the first arm, wherein the second grounding point is located on the second arm, and wherein each of the first grounding points is configurable for selective grounding;

a first data acquirer configured to acquire a target working frequency band;

a second data acquirer configured to acquire a holding status of a user; and a processor coupled to the antenna, the first data acquirer, and the second data acquirer and configured to adjust a first grounding combination of the antenna according to the target working frequency band and the holding status of the user, wherein the first grounding combination comprises a combination of grounding statuses of the multiple grounding points.

* * * * *